US009533200B2

(12) United States Patent
Dolezel et al.

(10) Patent No.: US 9,533,200 B2
(45) Date of Patent: Jan. 3, 2017

(54) GOLF CLUB INSERT

(71) Applicant: Dunlop Sports Company Limited, Kobe (JP)

(72) Inventors: Keith Dolezel, Huntington Beach, CA (US); Nick Trahan, Huntington Beach, CA (US); Phillip Seagram, Huntington Beach, CA (US); Mika Becktor, Huntington Beach, CA (US)

(73) Assignee: Dunlop Sports Company Limited, Kobe (JP)

( * ) Notice: Subject to any disclaimer, the term of this patent is extended or adjusted under 35 U.S.C. 154(b) by 0 days.

(21) Appl. No.: 14/740,988

(22) Filed: Jun. 16, 2015

(65) Prior Publication Data

US 2016/0016052 A1 Jan. 21, 2016

Related U.S. Application Data

(60) Provisional application No. 62/015,209, filed on Jun. 20, 2014.

(51) Int. Cl.
*A63B 53/04* (2015.01)

(52) U.S. Cl.
CPC ..... *A63B 53/04* (2013.01); *A63B 53/047* (2013.01); *A63B 2053/0408* (2013.01); *A63B 2053/0425* (2013.01); *A63B 2209/00* (2013.01)

(58) Field of Classification Search
CPC ..... A63B 53/04
See application file for complete search history.

(56) References Cited

U.S. PATENT DOCUMENTS

2003/0228928 A1* 12/2003 Yabu ..... A63B 53/04 473/290
2010/0261540 A1* 10/2010 Roach ..... A63B 53/04 473/291

OTHER PUBLICATIONS

Cobra Golf Baffler irons. Images and information available at: http://www.golf.com/equipment/cobra-baffler-hybrid-irons-clubtest-2013-review-iron-reviews. Feb. 21, 2013.
Cobra Golf. Cobra FP irons. Images and information available at: http://www.golfwrx.com/forums/topic/52975-cobra-fp/. Sep. 29, 2006.
Cobra Golf Cobra Amp irons. Images and information available at: http://www.golfalot.com/equipment-reviews/cobra-amp-irons-review-737.aspx. Dec. 29, 2011.

(Continued)

*Primary Examiner* — Michael Dennis
(74) *Attorney, Agent, or Firm* — Stetina Brunda Garred and Brucker; Mark B. Garred

(57) ABSTRACT

An insert for a golf club head, wherein the insert includes a generally planar base surface and a maximum thickness, $T_{max}$, measured perpendicular to the base surface. The insert further includes a first component comprising a non-metallic material, and a second component coupled to the first component and comprising a continuous, formed metal sheet having a thickness between 0.01 mm and 3.0 mm, the second component extending a maximum distance, D, in a direction perpendicular to the base surface, that is no less than 6 mm. The insert is configured such that a ratio $D/T_{max}$ is no less than 0.50.

15 Claims, 4 Drawing Sheets

(56) References Cited

OTHER PUBLICATIONS

Titleist Golf Titleist AP1 irons. Images and information available at: http://www.titleist.com/golf-clubs/irons/AP1.aspx. Nov. 7, 2010.
TaylorMade Golf Burner 2.0 irons. Images and information available at: http://valueguide.pga.com/detail.php?brand=2784&product_type=205&model=47826. Apr. 23, 2013.
Cleveland Golf Launcher irons. Images and information available at: http://valueguide.pga.com/detail-exec/brand/2677/product_type/205/model/44211/b/Cleveland/p/Iron%20set/m/Launcher. Oct. 22, 2006.

* cited by examiner

GOLF CLUB INSERT

CROSS-REFERENCE TO RELATED APPLICATIONS

This application is based on and claims benefit of U.S. Provisional Application No. 62/015,209, filed Jun. 20, 2014, entitled "Golf Club Insert." A claim of priority to this prior application is hereby made, and the disclosure of this prior application is hereby incorporated by reference.

BACKGROUND OF THE INVENTION

1. Field of the Invention

The present disclosure relates generally to golf club heads and, more specifically, inserts for golf club heads.

2. Background

When a golfer strikes a golf ball correctly, oftentimes the golfer will immediately know the shot is good based on the "feel" of the strike. In this respect, when the club head impacts the ball at the "sweet spot" of the club head, there are minimal vibrations which the golfer can feel. As a result, the swing and resultant strike feel pure. Thus, the golf industry has developed several products directed toward dampening the vibrations within a club head upon impact with a golf ball. For instance, inserts or plaques are commonly attached to the back of an iron-type golf club to reduce vibrations.

Several inserts exist having a multi-component composition of a resilient, polymeric backing component and a metallic sheet component. For example, inserts may include a visco-elastic, or resilient, material component capable of damping vibrations, thus controlling sound and feel. Sometimes, such components are combined with mass elements, optionally having higher densities and/or greater rigidity, further providing vibration tuning/control.

These inserts are often located on a rear surface of the club head, opposite the striking face. This position may provide optimal tuning of the vibrations emanating from a golf ball impact. However, this location may not always be an optimal location to place mass, particularly when a high moment of inertia is desired. However, heavy mass/volume in a central region of the striking face may lead a golfer to believe that the club will impart a solid shot and more positive feel, which belief increases player confidence further improving performance.

In view of the foregoing, there is a need in the art for an insert having relatively high thickness/volume, but low weight.

BRIEF SUMMARY OF THE INVENTION

Various aspects of the present disclosure are directed toward providing an improved insert adapted to be coupled to the rear face of a golf club head. The insert is specifically configured and adapted to have a relatively high thickness and volume, while maintaining a low weight.

According to one embodiment, there is provided a golf club head comprising a main body and an insert. The insert includes a generally planar base surface and a maximum thickness, $T_{max}$, measured perpendicular to the base surface. The insert further includes a first component comprising a non-metallic material, and a second component coupled to the first component and comprising a continuous, formed metal sheet having a thickness between 0.01 mm and 3.0 mm. The second component extends a maximum distance, D, in a direction perpendicular to the base surface, that is no less than about 6 mm. The insert is configured such that a ratio $D/T_{max}$ is no less than about 0.50.

The non-metallic component and metal component may be specifically oriented on the club head to provide the appearance or effect that the insert is of high mass or that a significant proportion of the volume of the insert is occupied by metal. This may be achieved by having the metal component climb vertically a large extent of the height (or thickness) of the insert, forming an exterior side wall of the insert. The metal sheet may also include various steps or ridges. The complexity in contour of the metal sheet may be made possible by a stamping process in which the sheet is only partially constrained during the stamping operation. This may allow greater material to be used in forming the stamped contour as the sheet need not stretch as much during the stamping process. The high thickness of the insert may also push the center of gravity of the club head further rearward, which improves shot trajectory and sweet area location/size.

The insert may be configured such that the maximum distance, D, is no less than about 8 mm. The golf club head may be configured such that the ratio, $D/T_{max}$, is no less than about 0.60.

The golf club head may additionally include an adhesive member located between, and coupling, the base surface of the insert and the main body. The adhesive member may include a double-sided adhesive tape having a thickness no less than about 0.25 mm.

The main body of the golf club head may further comprises a striking wall having a front surface and a rear surface, and the second component may be coupled to the rear surface of the striking wall. The golf club head may be an iron-type golf club head.

The formed metal sheet may comprise a flange extending generally parallel to the base surface and a sloped wall, in communication with the flange, extending outward relative to the base surface. The sloped wall may comprise a step formation.

According to another embodiment, the golf club head comprises an insert having a generally planar base surface and a maximum thickness, $T_{max}$, measured perpendicular to the base surface, that is no less than about 7 mm. The insert further includes a first component comprising a non-metallic material, and a second component coupled to the first component and comprising a continuous, formed metal sheet having a thickness between about 0.01 mm and about 3.0 mm. The second component extends a maximum distance D, in a direction perpendicular to the base surface, such that a ratio $D/T_{max}$ is no less than about 0.50. An adhesive body is located between, and couples, the base surface of the insert and the main body.

The golf club head may be configured such that $T_{max}$ is no less than about 8.0 mm.

The main body may further comprise a striking wall having a front surface and a rear surface, and the second component may be coupled to the rear surface of the striking wall.

According to another embodiment, there is provided a golf club head comprising a striking wall having a front surface and a rear surface opposite the front surface, a sole portion, and a rear wall extending upward from the sole portion. The rear wall comprises a forward surface, a rearward surface and an upper surface. A recess is formed by the rear surface of the striking wall, the sole portion, and the forward surface of the rear wall. An insert is coupled to the rear surface of the striking wall, with the insert being spaced from the forward surface of the rear wall by a minimum distance between about 0.25 mm and about 3 mm.

The golf club head may be configured such that when the club head is oriented in a reference position, the insert is entirely located above the rear wall.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION OF THE INVENTION

Figure 1:
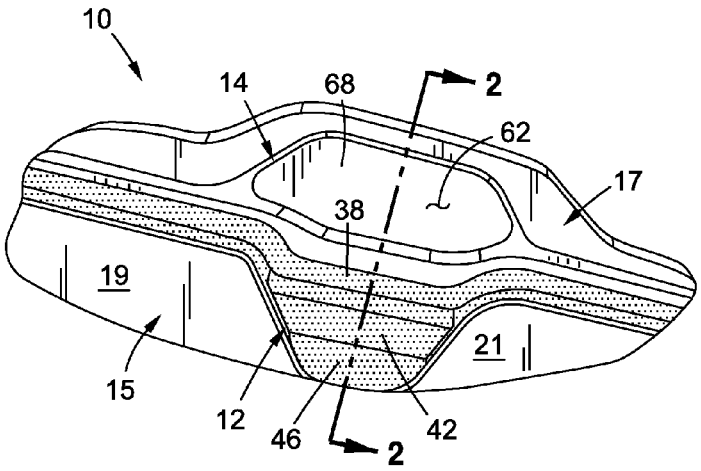
FIG. 1 is top view of an insert constructed in accordance with a first embodiment of the present disclosure.

Referring now to the drawings wherein the showings are for purposes of illustrating a preferred embodiment of the present disclosure only, and are not for purposes of limiting the same, there is depicted an insert 10 configured to be coupled to a rear surface of a golf club head. The insert 10 is specifically configured and adapted so as to create the impression that the insert 10 is of high mass and/or that a significant proportion of the volume of the insert 10 is occupied by metal. This effect is achieved by incorporating a thin metal sheet 12 into the insert 10, wherein the thin metal sheet 12 climbs vertically along a significant portion of the height (or thickness) of the insert 10 to form an exterior side wall of the insert 10. The appearance created by the insert 10 of having a centrally located heavy mass/volume of the striking face of the club head leads a golfer to believe that the club will impart a solid shot on the ball resulting in a more positive feel, which belief increases player confidence further improving performance.

Figure 2:
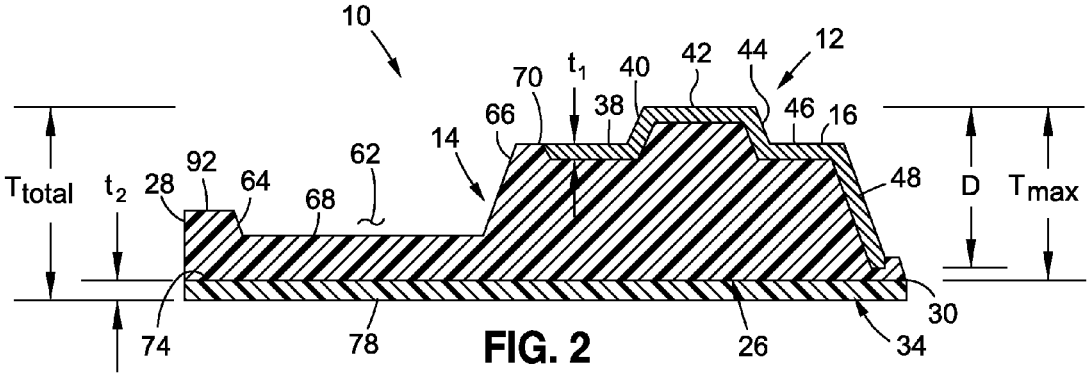
FIG. 2 is an assembled cross-sectional view of the insert depicted in FIG. 1.
Figure 3:
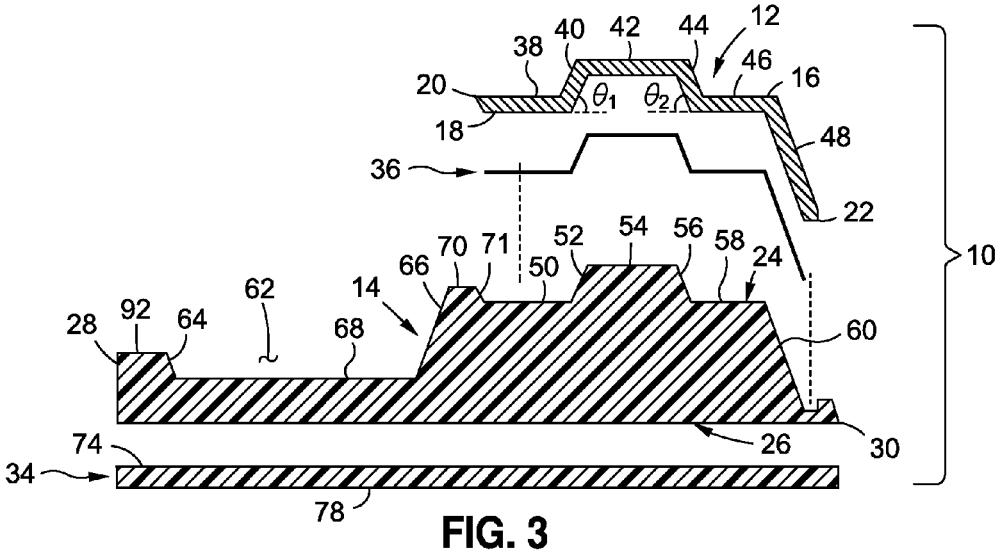
FIG. 3 is an exploded cross-sectional view of the insert depicted in FIG. 3, with a metallic component and adhesive element being exploded from a non-metallic component.

Referring now to FIGS. 1-3, the insert 10 defines a stepped profile and is generally comprised of the metallic component 12, as well as a non-metallic component 14 having a base surface 26. The non-metallic component 14 includes peripheral flanges 15, 17 on opposed sides of the metallic component 12. The flange 15 is further segregated by the metallic component 12 into first and second regions 19, 21. As will be described in more detail below, the non-metallic component 14 has a portion which protrudes outwardly relative to the peripheral flanges 15, 17 in a direction opposite the base surface 26. The metallic component 12 includes an external surface 16 and an opposing internal surface 18, as well as a first end 20 and a second end 22. The non-metallic component 14 includes a distal surface 24 (e.g., disposed away from the club head when the insert 10 is attached thereto), the aforementioned base surface 26 (e.g., disposed toward the club head when the insert 10 is attached thereto), a first end 28, and second end 30.

A first adhesive element 34, e.g., adhesive tape, extends along the base surface 26 of the non-metallic element 14 and may be used for coupling the insert 10 to the golf club head. Furthermore, certain embodiments of the insert 10 also include a second adhesive element 36 disposed between the metallic component 12 and the non-metallic component 14 to effectuate engagement therebetween. The second adhesive element 36 may be used in lieu of co-molding the metallic component 12 to the non-metallic component 14 so as to reduce manufacturing costs. However, those skilled in the art will appreciate that co-molding may be used to couple the metallic component 12 to the non-metallic component 14 without departing from the spirit and scope of the present disclosure.

In one particular implementation, the metallic component 12 has a multi-tiered configuration as it extends between its first and second ends 20, 22. Moving from the first end 20 toward the second end 22, the metallic component 12 includes a flange or first flat segment 38, a first sloped segment 40, a second flat segment 42, a second sloped segment 44, a third flat segment 46 and a third sloped segment 48. The use of the terms "flat" and "sloped" is derived from the perspective shown in FIGS. 2 and 3. In this regard, the first and third flat segments 38, 46 extend along a common first plane, while the second flat segment 42 extends along a second plane which is generally parallel to the first plane. However, it is contemplated that the first, second and third flat segments 38, 42, 46 may reside upon respective one of three different, generally parallel planes. The first and second sloped segments 42, 44 extend at prescribed angles between the aforementioned first and second planes in non-parallel relation to each other, with the third sloped segment 48 extending at a prescribed angle between the first plane and the second end 22. The metallic component 12 is also of a thickness $t_1$ as the perpendicular distance between the external surface 16 and the opposing internal surface 18.

According to one embodiment, the thickness $t_1$ of the metal component 12 is less than or equal to about 2.5 mm, while in another embodiment, the thickness $t_1$ is less than or equal to about 1.0 mm, and in yet another embodiment, the thickness $t_1$ is between about 0.40 mm and about 0.75 mm. Furthermore, according to one embodiment, the thickness $t_1$ is greater than or equal to about 0.01 mm, and in yet another embodiment, the thickness $t_1$ is greater than or equal to about 0.10 mm. These thickness ranges ensure sufficient durability, but limit the undesirable placement of a significant amount of mass. These upper thickness limits also ensure that the metal component 12 is suited for bending, drawing or other process of plastic deformation. Of course these thickness ranges are also dependent on the material used and degree of intended deformation.

The non-metallic component 14 also has a multi-tiered configuration, which is at least partially complementary to the multi-tiered configuration of the metallic component 12. In particular, portions of the distal surface 24 of the non-metallic component 14 are complementary to the discrete segments of the metallic component 12 as highlighted above include a first flat segment 50, a first sloped segment 52, a second flat segment 54, a second sloped segment 56, a third flat segment 58, and a third sloped segment 60. The non-metallic component 14 also includes an exposed cavity 62 which is collectively defined by an opposed pair of fourth and fifth sloped segments 64, 66 and an interconnecting fourth flat segment 68 of the distal surface 24. The fifth sloped segment 66 extends at a prescribed angle relative to a fifth flat segment 70 of the distal surface 24 of the non-metallic component 14, such fifth flat segment 70 being connected to the first flat segment 50 by an intervening sixth sloped segment 71 of the distal surface 24.

The metallic component 12 is positioned relative to the non-metallic component 14 such that the external surface 16 as defined by the first flat segment 38 is substantially flush with the fifth flat segment 70 of the non-metallic component 14. At the same time, as is best seen in FIG. 2, the first, second and third flat segments 38, 42, 46 of the metallic component 12 extend along and in substantially parallel relation to corresponding ones of the first, second and third flat segments 50, 54, 58 of the non-metallic component 14. Similarly, the first, second and third sloped segments 40, 44, 48 of the metallic component 12 extend along and in substantially parallel relation to corresponding ones of the first, second and third sloped segments 52, 56, 60 of the non-metallic component 14. As such, the resultant insert 10 has a plurality of surfaces which extend in generally parallel relation to each other, including the portions of the external surface 16 of the metallic component 12 as defined by the first, second, and third flat segments 38, 42, 46 thereof, as well as the fourth and fifth flat segments 68, 70 of the distal surface 24 of the non-metallic component 14.

The exemplary insert 10 is said to have a "two-step" configuration between that portion of the external surface 16 as defined by the second flat segment 42 and that portion of the distal surface 24 as defined by the fourth flat segment 68. In greater detail, the first step is from the portion of the external surface 16 as defined by the second flat segment 42 to the portion of the external surface 16 as defined by the first flat segment 38 as created by the intervening first sloped segment 40 of the metallic component 12. The second step is from the portion of the external surface 16 as defined by the first flat segment 38 and the portion of the distal surface 24 as defined by the fifth flat segment 70 to the portion of the external surface 24 as defined by the fourth flat segment 68 as created by the intervening fifth sloped segment 66 of the distal surface 24. Those skilled in the art will readily appreciate that the two-step configuration is exemplary only and does not limit the present disclosure. In this respect, other configurations of the insert 10 may be of a "single-step" configuration, while other configurations of the insert 10 may have more than two-steps.

The insert 10 has a maximum thickness, $T_{max}$, measured generally perpendicular to the base surface 26. As shown in FIG. 2, such maximum thickness $T_{max}$ is defined between the base surface 26 and that portion of the external surface 16 of the metallic component 12 as defined the second flat segment 42 thereof. The insert 10 further defines a maximum extending distance, D, along an axis generally perpendicular to the base surface 26, as the distance between the portion of the metallic component 12 closest to the base surface 26 and the portion of the metallic component 12 furthest from the base surface 26. In the exemplary embodiment depicted in FIGS. 2-3, the maximum extending distance D is defined as the distance between the second end 22 of the metallic component 12 (as defined by the distal end of the third sloped segment 48 thereof) and that portion of the external surface 16 as defined by the second flat segment 42.

According to one embodiment, the maximum thickness $T_{max}$ is greater than or equal to about 7.0 mm, while in another embodiment, the maximum thickness $T_{max}$ is greater than or equal to about 7.5 mm, while in yet another embodiment, the maximum thickness $T_{max}$ is greater than or equal to about 8.0 mm. Furthermore, according to one implementation, the maximum thickness $T_{max}$ is less than or equal to about 13.0 mm, while in another implementation, the maximum thickness $T_{max}$ is less than or equal to about 11.5 mm, and in yet another implementation, the maximum thickness $T_{max}$ is less than or equal to about 10.5 mm. These thickness ranges ensure that the insert 10 is sufficiently large to provide the robustness effect discussed above. However, these ranges also ensure that the thickness of the insert is sufficiently small as to fit within the confines of typical club head structure and/or not require undue mass.

According to one embodiment, the maximum extending distance D of the metallic component 12 is greater than or equal to about 6.0 mm, and in yet another embodiment, the maximum extending distance D is greater than or equal to about 7.0 mm, while in yet a further embodiment, the maximum extending distance D is greater than or equal to about 7.5 mm.

In one implementation, the insert 10 is configured such that the ratio of $D/T_{max}$ is greater than or equal to about 0.50, while in another embodiment, the ratio is greater than or equal to about 0.60, and in yet a further embodiment, the ratio is greater than or equal to about 0.70.

The insert 10 is uniquely configured such that the metallic component 12 extends or protrudes away from the base surface 26 to create the effect that a significant portion of the insert 10 is comprised of metal, when in fact, a large portion of the insert 10 is actually composed of a resilient, non-metallic material (i.e., the non-metallic component 14). With regard to the insert 10 shown in FIGS. 1-3, when a golfer views the insert 10, the exposed metallic third sloped segment 48 protruding from the non-metallic component 14 gives the insert 10 "depth" and creates the impression that the insert 10 has a high metallic volume, which will give the golfer confidence that impact with the golf ball will result in a desirable feel where the vibrations are dampened. Thus, various aspects of the present disclosure are directed toward creating an insert with a higher $D/T_{max}$ ratio compared to conventional inserts.

The adhesive tape 34 used to couple the insert 10 to the club head defines a thickness $t_2$ as the perpendicular distance between a generally planar inner surface 74 and an opposing, generally outer surface 78 each defined by the tape 34. The insert 10-adhesive tape 34 combination also defines a maximum total thickness $T_{total}$ as the distance between the outer surface 78 and the furthest portion of the insert 10 along an axis perpendicular to the outer surface 78, which is that portion of the external surface 16 of the metallic component 12 as defined by the second flat segment 42 thereof. In this respect, $T_{total}$ is equal to the summation of $T_{max}$ and $t_2$.

According to one embodiment, the adhesive layer thickness $t_2$ is less than or equal to about 2.0 mm, while in another embodiment, the thickness $t_2$ is less than or equal to about 1.25 mm, and in yet another embodiment, the thickness $t_2$ is less than or equal to about 1.0 mm. In another implementation, the adhesive layer thickness $t_2$ is greater than or equal to about 0.10 mm, while in another implementation, the adhesive layer thickness $t_2$ is greater than or equal to about 0.25 mm, and in yet another implementation, the thickness $t_2$ is between about 0.35 mm and about 0.65 mm. These ranges may ensure that the adhesive layer is sufficiently robust to ensure proper adhesion and, in some embodiments, to appropriately dampen undesirable vibrations. Yet, these ranges may also ensure that the adhesive layer 34 corresponds to a properly tuned degree of vibration dampening and is not bulky.

The insert 10 also defines a "step angle" (shown by the exemplary angle(s), $\theta_1$, $\theta_2$ in FIG. 3) between a plane parallel to the base surface 26 and those surface segments of the insert 10 characterized above as being "sloped." According to one embodiment, all of the step angle(s), including $\theta_1$, $\theta_2$, are identical to each other, and each greater than or equal to about 45 degrees. In another embodiment, all of the step angle(s), including $\theta_1$, $\theta_2$, are also identical to each other, and each greater than or equal to about 55 degrees. However, those of ordinary skill in the art will recognize that the insert 10 may be fabricated such that some variation in the step angles exists, without departing from the spirit and scope of the present disclosure.

According to one embodiment, the metallic component 12 is an aluminum alloy, such as aluminum alloy 1050, although other metallic materials known in the art may also be used. The metallic component 12 preferably is of a density approximately equal to about 2.7 g/cm$^3$ and has a percent elongation at fracture of less than or equal to about 12%, and more preferably in the range of about 8-12%.

The non-metallic component 14 is preferably formed of a resilient, polymeric material. According to one embodiment, the non-metallic component 14 is formed of thermoplastic polyurethane (TPU). In another implementation, the non-metallic component 14 is of a density in the range of approximately 1.1-1.25 g/cm$^3$.

In one implementation, the adhesive tape 34 used to couple the insert 10 to the club head is a double-sided adhesive tape and is formed of acryl foam. Furthermore, the adhesive tape 36 optionally used to couple the metallic component 12 to the non-metallic component 14 may be SUPER X8008, which is a CEMEDINE adhesive.

Those skilled in the art will readily appreciate that the materials provided above in relation to the metallic component 12, non-metallic component 14, adhesive tape 34 and adhesive tape 36 are exemplary only and are not intended to limit the scope of the present disclosure. In this respect, other materials known by those skilled in the art may also be used without departing from the spirit and scope of the present disclosure.

The unique configuration of the insert 10 allows the insert 10 to be used in a mixed set of cavity back iron club heads as well as hybrid-style (hollow) club heads. Furthermore, identical inserts 10 may be used to two or more differently lofted club heads in a given set of golf clubs. The universal nature of the insert 10 provides greater consistency in design throughout the set.

Figure 4:
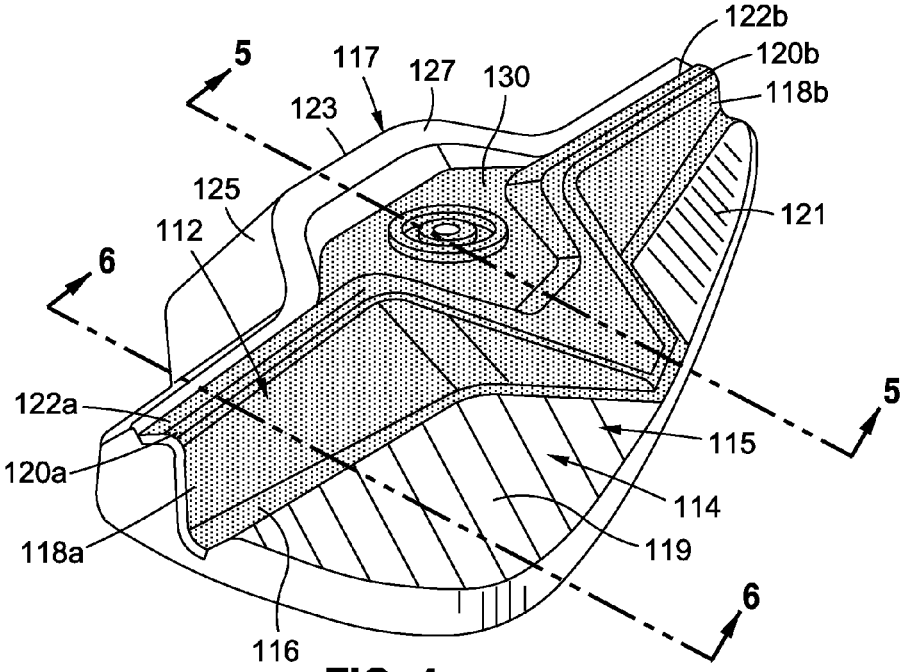
FIG. 4 is a top perspective view of an insert constructed in accordance with a second embodiment of the present disclosure.
Figure 5:
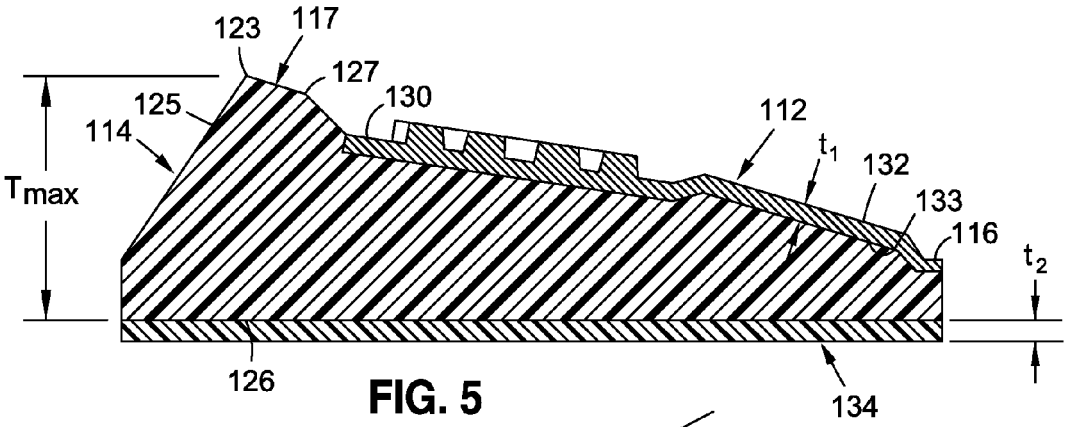
FIG. 5 is a cross-sectional view of the insert depicted in FIG. 4 taken along axis 5-5 of FIG. 4.
Figure 6:
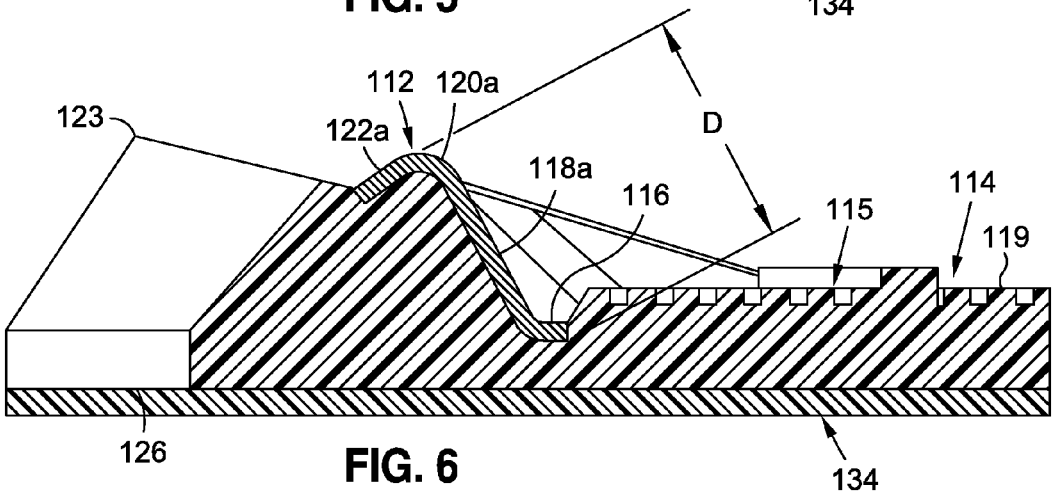
FIG. 6 is a cross-sectional view of the insert depicted in FIG. 4 taken along axis 6-6 of FIG. 4.

Referring now to FIGS. 4-6, there is depicted an insert 110 constructed in accordance with another embodiment and having a configuration which differs from the insert 10 depicted in FIGS. 1-3. Although the insert 110 is of a different configuration, the insert 110 defines a maximum thickness, $T_{max}$, and maximum extending distance, D, consistent with the parameters noted above in relation to the insert 10. In this respect, the insert 110 creates a similar appearance of having a deep metallic portion so as to increase the confidence of the golfer.

The insert 110 includes a metallic component 112 and a non-metallic component 114, which defines a generally planar base surface 126. The metallic component 112 is positioned opposite the base surface 126 and divides the non-metallic component 114 into first and second peripheral regions 115, 117. The first peripheral region 115 has a generally thin profile and is substantially segregated by the metallic component 112 into a pair of sub-regions 119, 121. The first peripheral region 115 may include a plurality of ribs 121 opposite the base surface 126. The second peripheral region 117 has a thicker profile than the first peripheral region 115, and includes an apex 123 which separates a pair of sloped segments 125, 127 thereof from each other.

The metallic component 112 of the insert 110 defines an exterior surface 132 and an opposed interior surface 133. In addition, at least the majority (but not necessarily all) of the metallic component 112 is of a thickness $t_1$ equal to the perpendicular distance between the opposed exterior and interior surfaces 132, 133 thereof.

The metallic component 112 includes a flange portion 116 coupled to the first peripheral region 115. The flange portion 116 extends along the length of one side of the metallic component 112. The flange portion 116 is integrally connected to and thus transitions into a pair of sloped segments 118*a*, 118*b* of the metallic component 112 which extend angularly relative to the first peripheral region 115 toward the second peripheral region 117. The sloped segment 118*a* terminates at an apex 120*a* which separates it from another sloped segment 122*a* of comparatively shorter length. Similarly, the sloped segment 118*b* terminates at an apex 120*b* which separates it from another sloped segment 122*b* of comparatively shorter length. The sloped segments 122*a*, 122*b* of the metallic component 112 each terminate at the sloped segment 127 defined by the second peripheral region 117. The sloped segments 118*a*, 122*a* and intervening apex 120*a* are separated from the sloped segments 118*b*, 122*b* and intervening apex 120*b* by a medial plate or portion 130 of the metallic component 112. As seen in FIG. 5, the flange portion is also integrally connected to the medial portion 130.

The insert 110 is of a maximum thickness, $T_{max}$, as the distance between the base surface 126 and the apex 123 (e.g., the portion of the insert 110 furthest from the base surface 126) along an axis generally perpendicular to the base surface 126. The insert 110 is also of a metallic maximum extending distance, D, as the distance between the interior surface 133 as defined by the flange portion 116 and the exterior surface 132 as defined by the apex 120*a*, e.g., the distance between the portion of the metallic component 112 closest to the base surface 26 and the portion of the metallic component 112 furthest from the base surface 26 along an axis generally perpendicular to the base surface 126.

The metallic component 112 may be coupled to the non-metallic component 114 using an adhesive, via co-molding, or using other adhesive elements known in the art. Furthermore, the insert 110 additionally includes an adhesive layer 134 that is of a thickness, $t_2$, wherein the adhesive layer 134 is used to connect the insert 134 to a club head. Though they are not labeled with particularity in FIGS. 5-6, the non-metallic component 114 of the insert 110 is formed to define exterior surface portions between the sub-regions 119, 121 of the first peripheral region 115 and the second peripheral region 117 which are complementary to corresponding portions of the interior surface 133 of the metallic component 112 as defined by the flange potion 116, the sloped segments 120*a*, 120*b*, 122*a*, 122*b* and intervening apices 120*a*, 120*b*, and the medial portion 130. Thus, when the metallic and non-metallic components 112, 114 are mated to each other through the use of one of the aforementioned techniques, the metallic component 112 receives uniform, stable support from the non-metallic component 114.

As noted above, the aforementioned parameters for D, $T_{max}$, $D/T_{max}$, $t_1$, and $t_2$ are also applicable to the insert 110 depicted in FIGS. 4-6. In this respect, the metallic component 112 creates a large, steep incline to create the effect of a thick and voluminous insert, which cultivates confidence for the golfer when viewing the insert 110.

Figure 7:
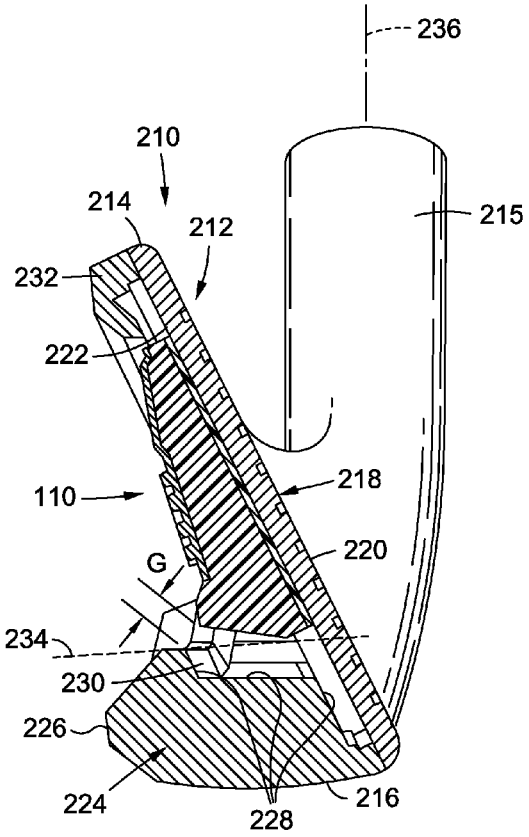
FIG. 7 is an assembled cross-sectional view showing the insert of FIGS. 4-6 coupled to an iron-type club head.

Referring now to FIG. 7, the insert 110 is shown attached to an iron-type club head 210. As noted above, the adhesive layer 134 is used to couple the insert 110 to the club head 210. The adhesive layer 134 may be a pressure sensitive adhesive, such that the insert 110 may be pressed against the club head 210 to effectuate coupling therebetween.

The club head 210 generally includes a main body 212 and a hosel 215 integrally connected to the main body 212 and adapted to facilitate the attachment of a club shaft to the golf club head 210. The main body 212 defines a top line 214 and an opposing sole 216 extending along the bottom of the main body 212. The main body 212 also includes a striking wall 218 having a front, striking face 220 adapted to strike a golf ball, and an opposing rear face 222.

The sole 216 is defined by a rear wall 224 connected to the striking wall 218 and protruding outwardly relative to the rear face 222. The rear wall 224 extends along a lower peripheral portion of the striking wall 218 and includes a stepped interior or forward surface 228 defining several discrete segments or sections. This interior surface 228 and a portion of the rear face 222 collectively define a recess 230. The rear wall 224 also defines rearward surface 226. A seen in FIG. 8, that portion of the exterior surface of the rear wall 224 separating the rearward surface 226 from the forward surface 228 includes an intermediate surface 229 which extends in spaced, generally parallel relation to that segment of the forward surface 228 which is of greatest length. An upper peripheral wall 232 of the club head 210 is connected to the striking wall 218 proximate the top line 214, and extends along an upper peripheral portion of the rear face 222. The upper peripheral wall 232, the rear wall 224, and the rear surface 222 collectively define a rear cavity 235, a portion of which is actually defined by the aforementioned recess 230. As will be described below, the rear cavity 235 accommodates the insert 110.

The insert 110 is placed within the rear cavity 235, with the adhesive layer 134 facing the rear face 222 and the metallic component 112 extending away from the rear face 222. The insert 110 is attached to the rear face 222, such that the insert 110 is spaced from the rear wall 224 by a minimum distance or gap, G. According to one embodiment, the insert 110 is spaced from the junction defined between the intermediate surface 229 and that segment of the forward surface 228 extending thereto by a minimum distance of between about 0.25 mm and about 3 mm. This degree of space may provide for the ability of a user to more easily clean out the rear cavity 235 of debris, e.g. by water spray or brush. These ranges for the gap G also enable ease of assembly.

Figure 8:
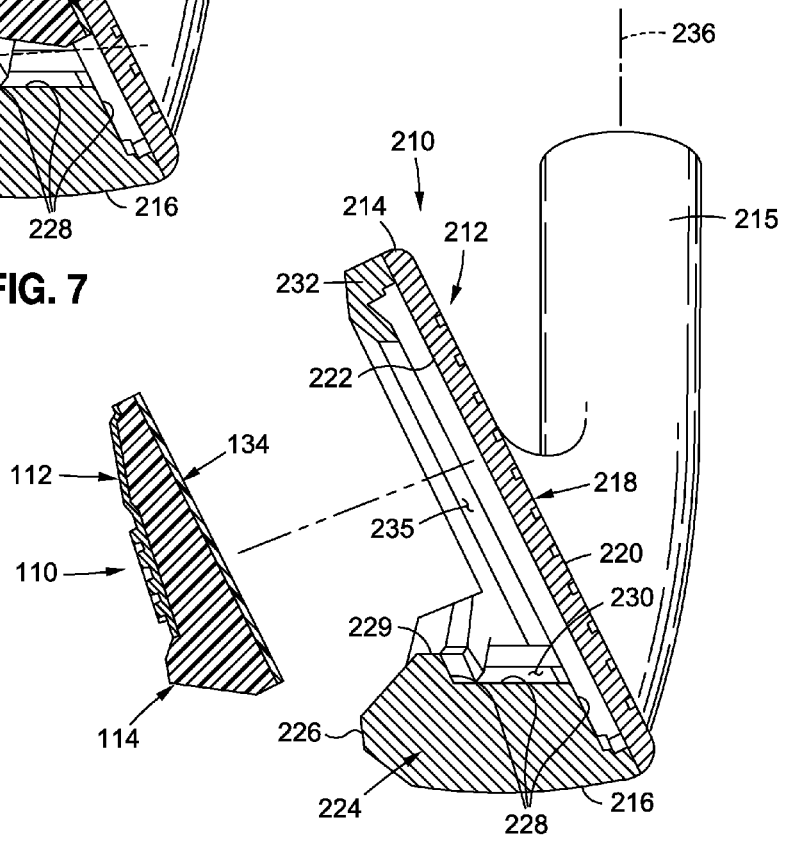
FIG. 8 is an exploded cross-sectional view showing the insert and club head depicted in FIG. 7.

The club head 210 depicted in FIGS. 7 and 8 is in a "reference position." When the golf club head 210 is in the reference position, a hosel axis 236 is oriented at a lie angle of approximately 60° with respect to a horizontal ground plane and lies in a vertical virtual plane relative to a reference ground plane. When the club head 210 is in the reference position, the insert 110 is preferably located entirely above the rear wall 224. FIG. 7 shows a horizontal plane 234 extending along the intermediate surface 229, and thus the highest point of the rear wall 224 as viewing the club head 210 in the reference position. As can be seen, the insert 110 is coupled to the club head 210 such that the insert 110 resides entirely above the horizontal plane 234.

When the insert 110 is coupled to the club head 210, the insert 110 may dampen the vibrations caused by impact between the club head 210 and the golf ball so as to create a more desirable feel for the golfer. Furthermore, the insert 110 creates an impression in the mind of the golfer that the insert 110 has a large thickness and weight, which tends to improve the confidence of the golfer.

Figure 9:
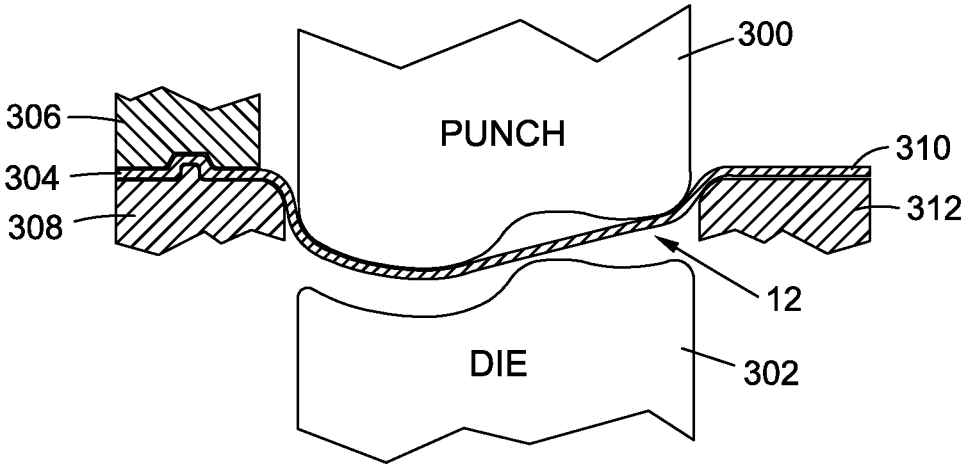
FIG. 9 is a sectional view of a metallic sheet for integration into an insert of the present disclosure as disposed between a punch and a die.
Figure 10:
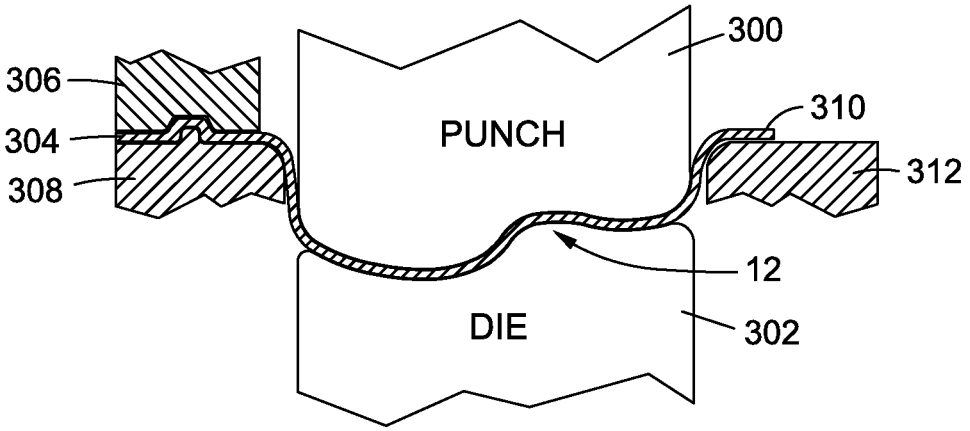
FIG. 10 is a sectional view of the metallic sheet, with the punch and die having moved toward each other relative to their respective positions depicted in FIG. 9 so as to form the shape of the metallic sheet integrated into the insert of the present disclosure.

Referring now specifically to FIGS. 9 and 10, there is depicted an exemplary method of forming the metallic component of the insert formed in accordance with either of the aforementioned embodiments of the present disclosure. The following description uses reference numeral 12 when referring to the metallic component, although the following discussion applies equally to the metallic component 112.

According to one embodiment, the metallic component 12 is stamped using a punch 300 and a corresponding die 302. A first end 304 of the metallic component 12 is clamped between a pair of clamping members 306, 308, and a second end 310 simply rests on a support 312 and is not clamped or otherwise constrained. In this respect, the second end 310 of the metallic component 12 is free. As the punch 300 moves closer to the die 302, the metallic component 12 is formed so as to define the desired configuration. Since the second end 310 of the metallic component 12 is free, the second end 310 may be drawn toward the punch 300 and die 302. In contrast, if the second end 310 was also clamped, the metallic component 12 would be stretched when forming the same. Thus, by clamping only one end of the metallic component 12, more metal material may be used in forming the stamped contour, as the metallic sheet need not stretch as much during the stamping process.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. A golf club head comprising:

a main body; and an insert having:

a generally planar base surface and a maximum thickness, $T_{max}$, measured perpendicular to the base surface;

a first component comprising a non-metallic material; and a second component coupled to the first component and comprising a continuous, formed metal sheet having a thickness between 0.01 mm and 3.0 mm, the second component extending a maximum distance, D, in a direction perpendicular to the base surface, that is no less than 6 mm, wherein a ratio $D/T_{max}$ is no less than 0.50.

2. The golf club head of claim 1, wherein the maximum distance, D, is no less than 8 mm.

3. The golf club head of claim 1, wherein the ratio, $D/T_{max}$, is no less than 0.60.

4. The golf club head of claim 1, further comprising an adhesive member located between, and coupling, the base surface of the insert and the main body, the adhesive member comprising a double-sided adhesive tape having a thickness no less than 0.25 mm.

5. The golf club head of claim 1, wherein the main body further comprises a striking wall having a front surface and a rear surface, and the second component is coupled to the rear surface of the striking wall.

6. The golf club head of claim 1, wherein the golf club head comprises an iron-type golf club head.

7. The golf club head of claim 1, wherein the formed metal sheet comprises a flange extending generally parallel to the base surface and a sloped wall, in communication with the flange, extending outward relative to the base surface.

8. The golf club head of claim 7, wherein the sloped wall comprises a step formation.

9. A golf club head comprising:

a main body;

an insert having:

a generally planar base surface and a maximum thickness, $T_{max}$, measured perpendicular to the base surface, that is no less than 7 mm;

a first component comprising a non-metallic material; and a second component coupled to the first component and comprising a continuous, formed metal sheet having a thickness between 0.01 mm and 3.0 mm, the second component extending a maximum distance D, in a direction perpendicular to the base surface, such that a ratio $D/T_{max}$ is no less than 0.50; and an adhesive body located between, and coupling, the base surface of the insert and the main body.

10. The golf club head of claim 9, wherein $T_{max}$ is no less than 8.0 mm.

11. The golf club head of claim 9, wherein the ratio, $D_1/T_{max}$, is no less than 0.60.

12. The golf club head of claim 9, wherein the adhesive body comprises a double-sided adhesive tape having a thickness no less than 0.25 mm.

13. The golf club head of claim 9, wherein the main body further comprises a striking wall having a front surface and a rear surface, and the second component is coupled to the rear surface of the striking wall.

14. The golf club head of claim 9, wherein the golf club head comprises an iron-type golf club head.

15. The golf club head of claim 9, wherein the formed metal sheet comprises a flange extending generally parallel to the base surface and a sloped wall, in communication with the flange, extending outward relative to the base surface.

* * * * *